US009440366B2

(12) United States Patent
Tomassetti et al.

(10) Patent No.: US 9,440,366 B2
(45) Date of Patent: Sep. 13, 2016

(54) SYSTEM FOR REGULATING ELECTRIC CURRENT FLOW FROM A POWER SOURCE TO A BLADE CARTRIDGE IN A WET SHAVE RAZOR

(71) Applicants: Louis D. Tomassetti, Pompano Beach, FL (US); William Bohmer, Randolph, NJ (US)

(72) Inventors: Louis D. Tomassetti, Pompano Beach, FL (US); William Bohmer, Randolph, NJ (US)

(73) Assignee: HEATED BLADES HOLDING COMPANY, LLC, Pompano Beach, FL (US)

( * ) Notice: Subject to any disclaimer, the term of this patent is extended or adjusted under 35 U.S.C. 154(b) by 86 days.

(21) Appl. No.: 14/080,903

(22) Filed: Nov. 15, 2013

(65) Prior Publication Data

US 2015/0135538 A1 May 21, 2015

(51) Int. Cl.

*B26B 19/48* (2006.01)
*B26B 21/40* (2006.01)
*B26B 21/48* (2006.01)

(52) U.S. Cl.

CPC ..... *B26B 21/405* (2013.01); *B26B 21/48* (2013.01); *Y10T 307/406* (2015.04)

(58) Field of Classification Search

CPC ..... B26B 21/405; B26B 21/48
See application file for complete search history.

(56) References Cited

U.S. PATENT DOCUMENTS 2,425,686 A * 8/1947 Porter ..... H05B 3/342 219/486
5,064,993 A * 11/1991 Hashimoto ..... A45D 24/10 132/118
6,836,966 B2 * 1/2005 Patrick ..... B26B 19/382 30/140
8,533,958 B2 * 9/2013 Tomassetti ..... B26B 21/48 30/140
8,661,687 B2 * 3/2014 Rebaudieres ..... B26B 21/14 30/32
8,713,801 B2 * 5/2014 Bohmer ..... B26B 21/48 219/50
8,943,899 B2 * 2/2015 Jukes ..... G01F 1/8422 73/861.357
2012/0081097 A1 * 4/2012 Birnbach ..... G05F 1/10 323/304
2012/0222310 A1 * 9/2012 Tomassetti ..... B26B 21/48 30/34.05
2014/0245611 A1 * 9/2014 Bohmer ..... B26B 21/48 30/34.05
2015/0135538 A1 * 5/2015 Tomassetti ..... B26B 21/405 30/45

FOREIGN PATENT DOCUMENTS

WO WO 2015/073783 A1 * 5/2015

* cited by examiner

*Primary Examiner* — Hwei C Payer
(74) *Attorney, Agent, or Firm* — Robert M. Downey, P.A.

(57) ABSTRACT

A system for regulating current flow in a wet shave razor includes one or more conductive materials, such as metals, in electric circuit connection, wherein each conductive material has unique resistance properties and is used to regulate the amount of current (i.e. heat) flowing to at least one electrically powered component on the blade cartridge, and particularly one or more electrically powered devices/elements on the blade cartridge such as, but not limited to, one or more blades, one or more heating elements, a vibration device, illuminating device (e.g. LED or bulb), gauges, or indicators. The length and thickness of the conductive materials used in the electric circuit further affects the total circuit resistance and, accordingly, the amount of current flowing to the blade cartridge for heating the blades. In other embodiments, the dissimilar material conductors may be used to regulate current flow to alternative electrically conductive components.

11 Claims, 2 Drawing Sheets

SYSTEM FOR REGULATING ELECTRIC CURRENT FLOW FROM A POWER SOURCE TO A BLADE CARTRIDGE IN A WET SHAVE RAZOR

FIELD OF THE INVENTION

The present invention relates to wet shave razors and, more particularly, a method and system for regulating electric current flow from an electric power storage source to a blade cartridge, including one or more blades and/or any part of the blade cartridge superstructure of a wet shave razor.

DISCUSSION OIF THE RELATED ART

When shaving with a wet shave razor, it is generally desired to warm the blades and/or blade cartridge superstructure for increased comfort. Moreover, it is well established that heated blades are capable of cutting hair more effectively than blades at room temperature. Users of traditional non-heated blade razors generally run hot water over the blades prior to use, a process which must be frequently repeated because the heat dissipates quickly from the blades and surrounding cartridge material. To counter this problem, electrically powered wet shave razors have been developed which serve to electrically heat either the blades or areas of the surrounding cartridge superstructure during use. A common problem associated with heating the blades is the difficulty associated with regulating the temperature of the blades, which often causes the blades to become uncomfortably hot, or not warm enough, when contacting a user's skin. While it is possible to use microelectronics to regulate the electrical current going through the blades to maintain the blades within a particular temperature range, use of microelectronics for his purpose has inherent drawbacks. For example, use of microelectronics for regulating electric current is costly, prone to malfunction, and does not work well in wet environments.

Therefore, there remains a particular need to provide a low-cost electrically powered wet shave razor that efficiently regulates electric current flow from an electric power storage source (e.g. battery source in the handle) to the blade cartridge for controlled operation of one or more electrically powered devices/elements on the blade cartridge such as, but not limited to, one or more blades, one or more heating elements (i.e. attached to the back of the blades or embedded within or attached to the cartridge frame), a vibration device, illuminating device (e.g. LED or bulb), gauges, or indicators.

SUMMARY OF THE INVENTION

The present invention is directed to a method and system for regulating electric current flow in a wet shave razor using dissimilar material conductors in an electric circuit between a battery power source and the blade cartridge, and particularly one or more electrically powered devices/elements on the blade cartridge such as, but not limited to, one or more blades, one or more heating elements (i.e. attached to the back of the blades or embedded within or attached to the cartridge frame), a vibration device, illuminating device (e.g. LED or bulb), gauges, or indicators. Specifically, a combination of conductive materials, such as metals, in connection, wherein each conductive material has unique resistance properties, is used to regulate the amount of current (i.e. heat) flowing to the blade cartridge. The length and thickness of the conductive materials used in the electric circuit further affects the total circuit resistance and, accordingly, the amount of current flowing to the blade cartridge. Use of dissimilar material conductors in connection with a battery power source to regulate current flow could be utilized for directly heating the razor blades or, alternatively, for regulation of lighting and/or gauges on the cartridge or regulation of heating elements on the cartridge for added shaving comfort. In other embodiments of the invention, the material conductors in the electric circuit connection are used to regulate the amount of current flowing to an electrically powered component on the blade cartridge.

OBJECTS AND ADVANTAGES OF THE INVENTION

Considering the foregoing, it is a primary object of the present invention to provide method and system for regulating the electric current flow to the blade cartridge of a wet shave razor using dissimilar material conductors.

It is a further object of the present invention to provide a cost efficient system for regulating the electric current flow to the blade cartridge in a wet shave razor.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF INVENTION

Referring to the several views of the drawings, the system for regulating electric current flow from a power source to a blade cartridge on a wet shave razor is shown and is generally indicated as 10.

Figure 1:
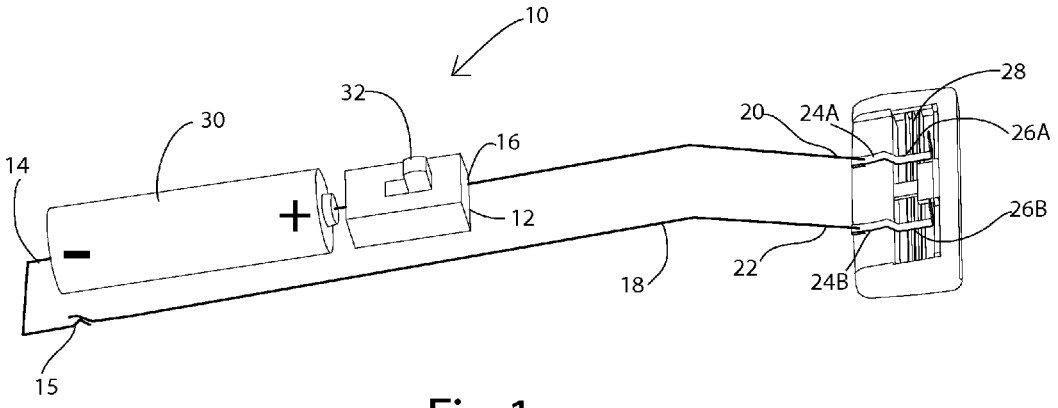
FIG. 1 is a perspective view of one embodiment of the heated blade razor illustrating the internal components of the heated blade razor.

Referring to FIG. 1, a first embodiment of the heated blade razor system 10 includes a main body 12 having a ground contact component 14, a cap contact component 15, a power lead component 16, a ground lead component 18, a power lead contact component 20, a ground lead contact component 22, a first and second contact component 24A and 24B, and a first and second blade lead contact component 26A and 26B. Each component 14-26B is in electric circuit connection with one or more blades 28 held together in a blade cartridge and is made from a particular material conductor selected for generation of optimum blade 28 temperature, wherein one or more of the material conductors are dissimilar from the other material conductors. The dissimilar material conductors may be selected from a group of materials including, but not limited to: stainless steel, brass, and nickel-chromium alloy.

Still referring to FIG. 1, the heated blade razor 10 includes a battery power source 30 in connection with a switch 32 (4.5 Amp) for powering the heated razor 10. In operation, the switch 32 is moved to the ON position by the user to close the electric circuit, thereby sending electric current flow through the blades 28 to heat the blades 28. The temperature of the blades is dependent on the particular material conductors selected for each of the ground contact component 14, the cap contact component 15, the power lead component 16, the ground lead component 18, the power lead contact component 20, the ground lead contact component 22, the first and second contact components 24A and 24B, and the first and second blade lead contact components 26A and 26B. Other variables, such as wire length and wire width of the electric circuit components 14-26B, may be altered in order to produce a particular blade temperature. The wires forming the electric circuit components 14-26B may be coiled in order to maximize wire length within a compact area for increasing the total resistance of the circuit. For example, the wires can be arranged in a cylindrical coil or a spiraling coil in order to increase the length of the wire within the compact area provided. An insulating material may be used in between the wire coils or, alternatively, the wires may include an insulating jacket for preventing the wire from contacting itself.

The following table provides an example of the material conductors selected for components 14-26B of heated razor 10:

| Component | Material Conductor |
|---|---|
| Ground contact component (14) | Stainless steel |
| Cap contact component (15) | Brass |
| Power lead component (16) | Brass |
| Ground lead component (18) | Brass |
| Power lead contact component (20) | Brass |
| Ground lead contact component (22) | Brass |
| Contact components (24A, 24B) | Brass |
| Blade lead contact components (26A, 26B) | Nickel-chromium |

Figure 2:
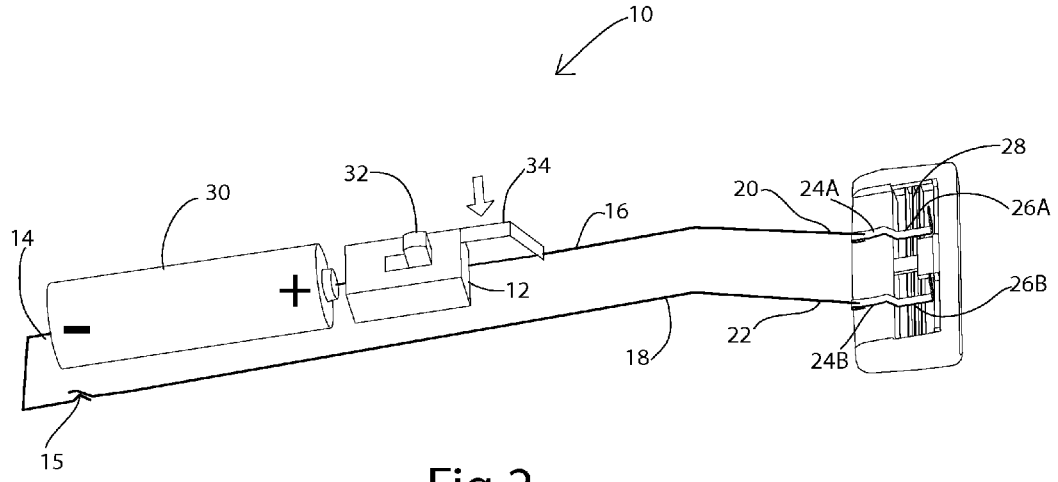
FIG. 2 is a perspective view of an alternative embodiment of the heated razor illustrating the internal components thereof.

Referring to FIG. 2, an alternative embodiment of the heated blade razor 10 is shown, wherein the main body 12 includes a button 34 for engaging an additional loop to the electric circuit in order to increase the total resistance of the circuit, thereby decreasing the amount of electric current flow to the blade cartridge and decreasing the temperature of the one or more blades 28 while the button 34 is engaged. In operation, button 34 may be pressed by the user during the shaving process in order to decrease the temperature of the blades 28. When the button 34 is released, the additional loop is disengaged and the temperature of the blades 28 returns to the original (i.e. hotter) temperature. Additional loops may be added to the circuit which, when engaged, further decrease the temperature of the blades.

Figure 3A:
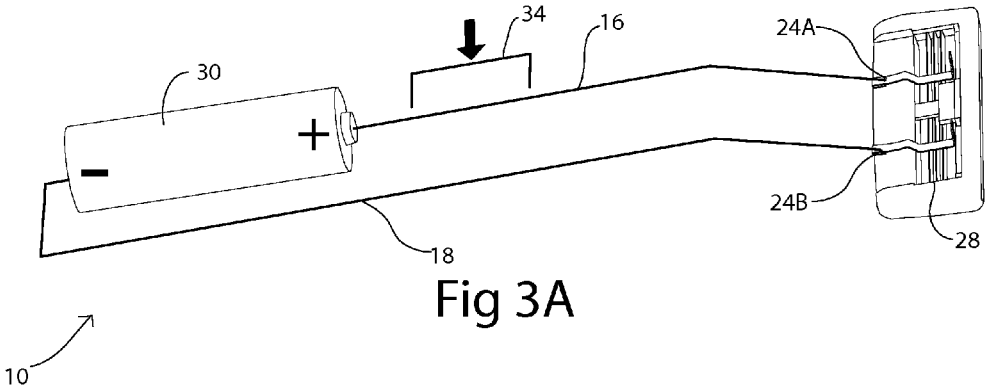
FIG. 3A is a schematic illustration showing the closed electric circuit of the heated blade razor in its resting state.
Figure 3B:
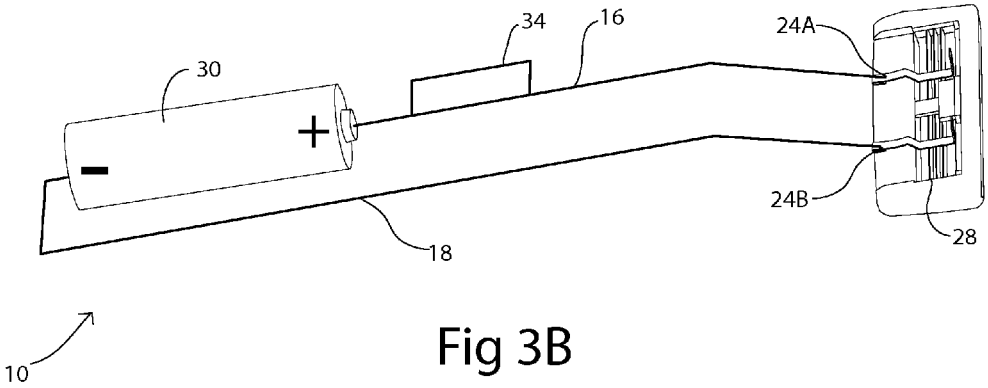
FIG. 3B is a schematic illustration showing the closed electric circuit of the heated blade razor with an additional loop added to the electric circuit.

Referring to FIGS. 3A and 3B, the process described above, wherein button 34 is pressed by the user during the shaving process in order to engage an additional loop to the electric circuit so that the distance the electric current flow travels is increased and the blades are cooled, is shown. FIG. 3A illustrates the electric circuit in its resting state, wherein button 34 is not pressed. FIG. 3B illustrates the electric circuit with the additional loop created when button 34 is engaged for decreasing the temperature of blades 28. Additional loops may be added to the circuit which, when engaged, further control the temperature of the blades.

Figure 4:
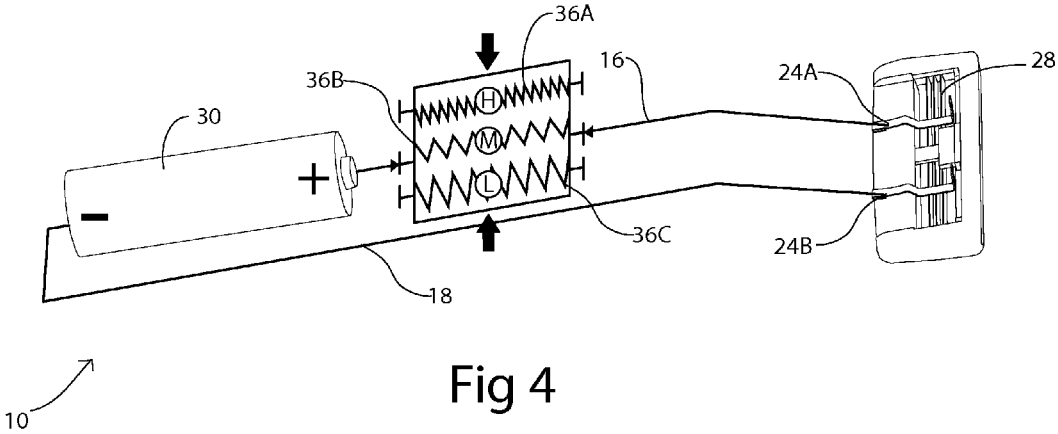
FIG. 4 is a schematic illustration showing an alternative embodiment of the closed electric circuit of the heated blade razor and including three different material conductor segments being selectively operable by a user.

Referring to FIG. 4, the use of dissimilar material conductors in connection with a battery power source 30 for regulating electric current flow can be utilized in a system including two or more separate circuits, each having a unique set of material conductors and each circuit having a different resistance, wherein the user can alternate between each of the two or more circuits to send a different electric current flow (e.g. high, medium, low) to the blade cartridge. As shown in FIG. 4, one embodiment of the heated blade razor 10 includes separate material conductors 36A, 36B and 36C selectively operable using a slide switch (not pictured) to put one of the separate material conductors 36A, 36B or 36C in connection with opposite ends of power lead component 16. Each of the separate material conductors 36A, 36B and 36C has a different resistance for producing a unique electric current flow in the circuit, such as high (least resistance), medium (medium resistance) and low (most resistance), as indicated by the H, M, and L on FIG. 4.

Use of dissimilar material conductors in connection with a battery power source 30 for regulating electric current flow could be utilized for applications other than directly heating the razor blades 28. Examples of alternative applications for use of dissimilar material conductors for regulating current flow to an electrically conductive component include, but are not limited to, regulation of lighting on the blade cartridge, gauges, indicator and/or regulation of heating elements on the blade or blade cartridge for added shaving comfort.

Use of dissimilar material conductors in connection with a battery power source 30 can be used in conjunction with one or more light emitting diodes (LEDs) or bulbs as part of the electric circuit with means for selectively connecting and disconnecting (e.g. a switch) each LED or bulb to the circuit, wherein each LED or bulb adds further resistance to thereby allow for further regulation of current flow. The LEDs or bulbs can serve as indicators (e.g. temperature indicators) in addition to providing the function of varying the total resistance in the circuit.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. A shaving device adapted to receive electric current flow from an electric power source, said device comprising:

a blade cartridge including at least one electrically powered component; and an electric circuit for delivering the electric current flow from the electric power source to said at least one electrically powered component, and said electric circuit including:

a plurality of material conductors interconnected to one another, to said electric power source, and to said at least one electrically powered component and including at least a first material conductor, and a second material conductor, wherein each of said first and second material conductors has a different electric resistance that is selected for achieving a desired regulated electric current flow to said at least one electrically powered component, and wherein each of said plurality of material conductors has a unique width; and a switch selectively operable between an ON status for allowing the electric current flow from said electric power source through said electric circuit and an OFF status for interrupting the electric current flow through said electric circuit.

2. The shaving device as recited in claim 1 wherein said switch is operable to a plurality of ON status positions to selectively change a total resistance of the electric circuit at each of the plurality of ON status positions.

3. The shaving device as recited in claim 2 wherein operation of said switch between each of the plurality of ON status positions changes the amount of electric current flow to said at least one electrically powered component.

4. The shaving device as recited in claim 1 wherein said at least one electrically powered component is at least one electrically conductive blade.

5. The shaving device as recited in claim 1 wherein said at least one electrically powered component is at least one heating element in contact with at least one blade in said blade cartridge.

6. The shaving device as recited in claim 1 wherein said at least one electrically powered component is at least one heating element in contact with said blade cartridge.

7. The shaving device as recited in claim 1 wherein said at least one electrically powered component is at least one light.

8. A shaving device adapted to receive electric current flow from an electric power source, said device comprising:

a blade cartridge including at least one electrically powered component;

an electric circuit for delivering the electric current flow from the electric power source to said at least one electrically powered component, and said electric circuit including a plurality of material conductors interconnected to one another, to said electric power source, and to said at least one electrically powered component, and said plurality of material conductors including:

a first material conductor;

a second material conductor; and a third material conductor;

each of said first, second, and third material conductors being selected from a group consisting of at least two dissimilar materials having different electric resistances that are selected for achieving a desired regulated electric current flow to said at least one electrically powered component; and a switch selectively operable between an ON status for allowing the electric current flow from said electric power source through said electric circuit and an OFF status for interrupting the electric current flow through said electric circuit.

9. The shaving device as recited in claim 8 wherein said switch is operable to a plurality of ON status positions to selectively change a total resistance of the electric circuit at each of the plurality of ON status positions, and thereby changing the amount of electric current flow to said at least one electrically powered component.

10. The shaving device as recited in claim 8 wherein each of said plurality of material conductors has a unique length.

11. The shaving device as recited in claim 8 wherein each of said plurality of material conductors has a unique width.

* * * * *